US005806670A

United States Patent [19]

Harlan et al.

[11] Patent Number: 5,806,670

[45] Date of Patent: Sep. 15, 1998

[54] PORTABLE MULTIPURPOSE PILL BOX CONTAINER

[76] Inventors: Thomas A. Harlan, 8800 Featherhill Rd., Austin, Tex. 78703; Joseph F. Long, 1335 Lost Creek Blvd., Austin, Tex. 78746

[21] Appl. No.: 885,779

[22] Filed: Jun. 30, 1997

[51] Int. Cl.[6] ..... B65D 85/58

[52] U.S. Cl. ..... 206/232; 206/216; 206/459.1; 206/538; 220/523; 220/524; 220/532; 116/67 R; 364/705.01

[58] Field of Search ..... 206/216, 232, 206/459.1, 538, 539; 220/523, 524, 532, 533; 116/67 R; 364/705.01

[56] References Cited

U.S. PATENT DOCUMENTS 4,253,572 3/1981 Halbich ..... 220/524
4,735,318 4/1988 Keffeler ..... 206/538
5,011,018 4/1991 Keffeler ..... 206/532
5,377,839 1/1995 Relyea et al. ..... 206/539

*Primary Examiner*—Jimmy G. Foster

[57] ABSTRACT

A pocket size portable pill box with dual rounded bottom compartments with said compartments subdivideable by the user and with said compartments closed by snap action of a lid to form individual small compartments; said pill box further equipped with a removable filling means and means to changeably label the desired contents of each compartment. Some embodiments of the invention further having a make-up kit, a computer, or an audible alarm mounted on one surface of the boxlike unit.

12 Claims, 4 Drawing Sheets

PORTABLE MULTIPURPOSE PILL BOX CONTAINER

BACKGROUND OF THE INVENTION

With continued advances in the field of Medicine and increasing life span many people take a variety of pills in any one day. The objective of the first embodiment of this invention is to provide a closeable compartmented container with each compartment being so shaped as to allow easy removal of a part or all of the pills and to provide a simple mode for labeling and changing the label of each compartment. An additional objective is to have a low cost unit of a size that may be slipped in a man's shirt pocket or easily carried in a small purse. A further objective is to have an associated funnel or boatlike structure to aid one in properly filling each compartment without dropping or spilling the pills being transferred.

In a second embodiment of the invention a small compact or make-up unit is attached to the bottom of the container to provide a dual purpose unit. In a third embodiment of the unit a thin small computer is attached to the bottom of the unit. In a fourth embodiment an alarm manually settable to activate at intervals chosen by the user is attached to the bottom of the unit.

In all embodiments there is a provision to allow changeably labeling each compartment and each has written and pictorial instructions.

SUMMARY OF THE INVENTION

One embodiment of the invention comprises a multicompartment, portable pillbox with compartment size as chosen by the user; snap shut lids to close all compartments; and a boatlike structure to aid in filling each compartment with the proper pills. Each unit has a slide in card and/or labels to allow the user to label the contents that he or she intends to have in each compartment. Pictorial instructions are also included. In one embodiment a small computer is attached to one side of the box and in other embodiments a make-up kit or a user settable alarm is attached to the portable box. Either fixed or removable attachment may be used. The unit may be manufactured using clear or colored plastic or plastic composite or metal with plastic being preferable.

DESCRIPTION OF THE INVENTION

The invention may best be described from the drawings. Simply said the purpose of the unit is to aid people taking a various number of various different solid medications at various times of the day to correctly use the medications as prescribed. The unit is sized and designed to be easily transported in a non obvious manner and some embodiments have secondary uses to further probability of proper use.

Figure 1:
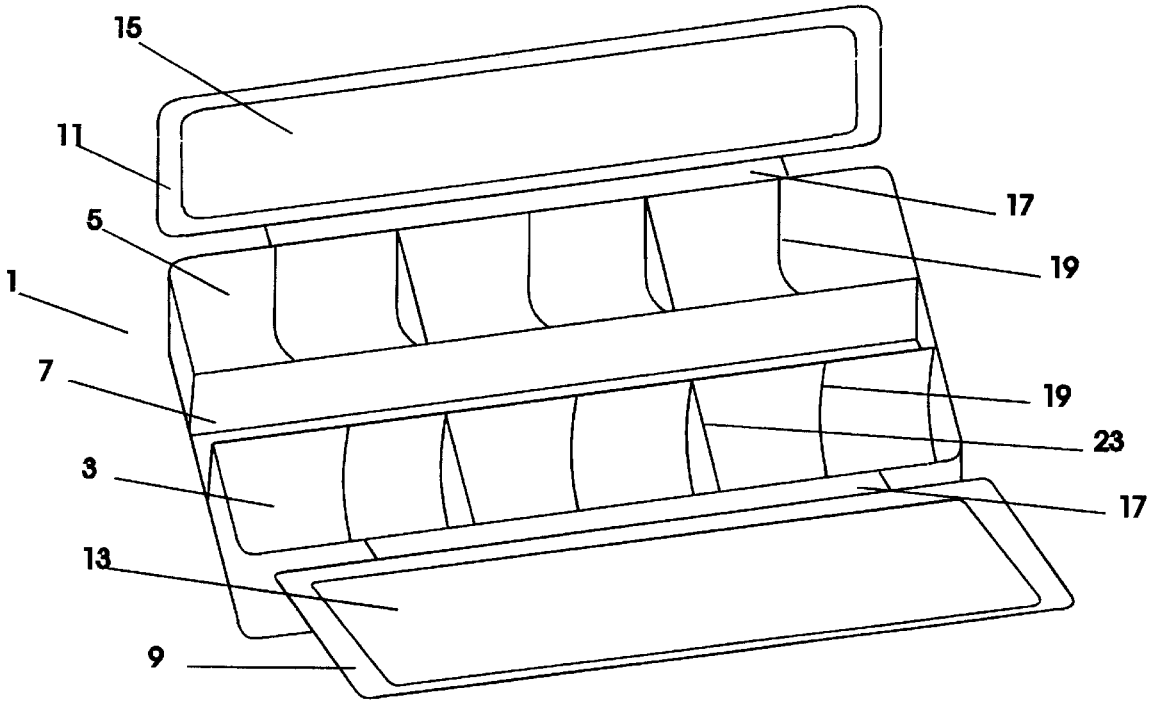
FIG. 1 shows a three dimensional view of the basic unit.

FIG. 1 shows a three dimensional view of one embodiment of the basic unit 1. The overall dimensions of this unit may be about three inches wide, three fourths of an inch deep and about five inches long. The boxlike portion has a first elongated rounded bottom channel 5 and a second similar round bottom channel 3. Both of these compartments have channels or indentations 19 to allow subdividing with essentially half round plastic strips 23. The compartments are separated by channel 7 which is open on one end. The rounded bottoms in compartments 3 and 5 are a necessity for easy removal of one or more pills therein by simply raking the pill or pills into channel 7 with one finger. The lids 9 and 11 which are preferably attached with a molded hinge 17 and are preferably of a snap shut type may be snapped shut to allow the user to empty the pills removed from their compartments while all other pills are held in individual closed compartments. Removable plastic inserts 15 and 13 both have a surface that allows writing and erasure so that a user may label name, number and dosage for pills in each compartment. On top of one of the lids 9 or 11 are pictorial instructions for use (not shown).

Figure 2:
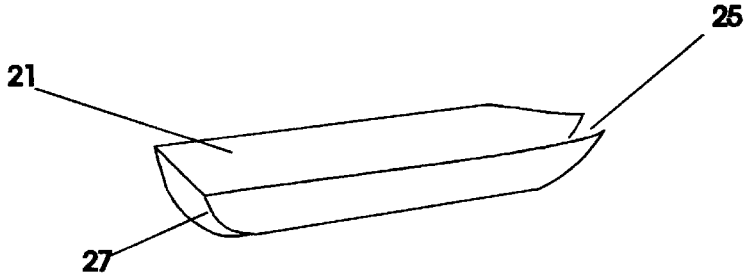
FIG. 2 shows a boatlike structure shaped to allow filling of compartments in the container or scooping pills out of compartments in the unit.

In FIG. 2 a boatlike structure 21 that is sized to slide into and be frictionally held in channel 7 is shown. This unit may be used to aid in proper filling of each compartment by pouring the pills into boat 21 and emptying into the correct compartment through pour spot 25. End 27 of boat 21 is shaped to act as a scoop to remove pills from a compartment.

Figure 3:
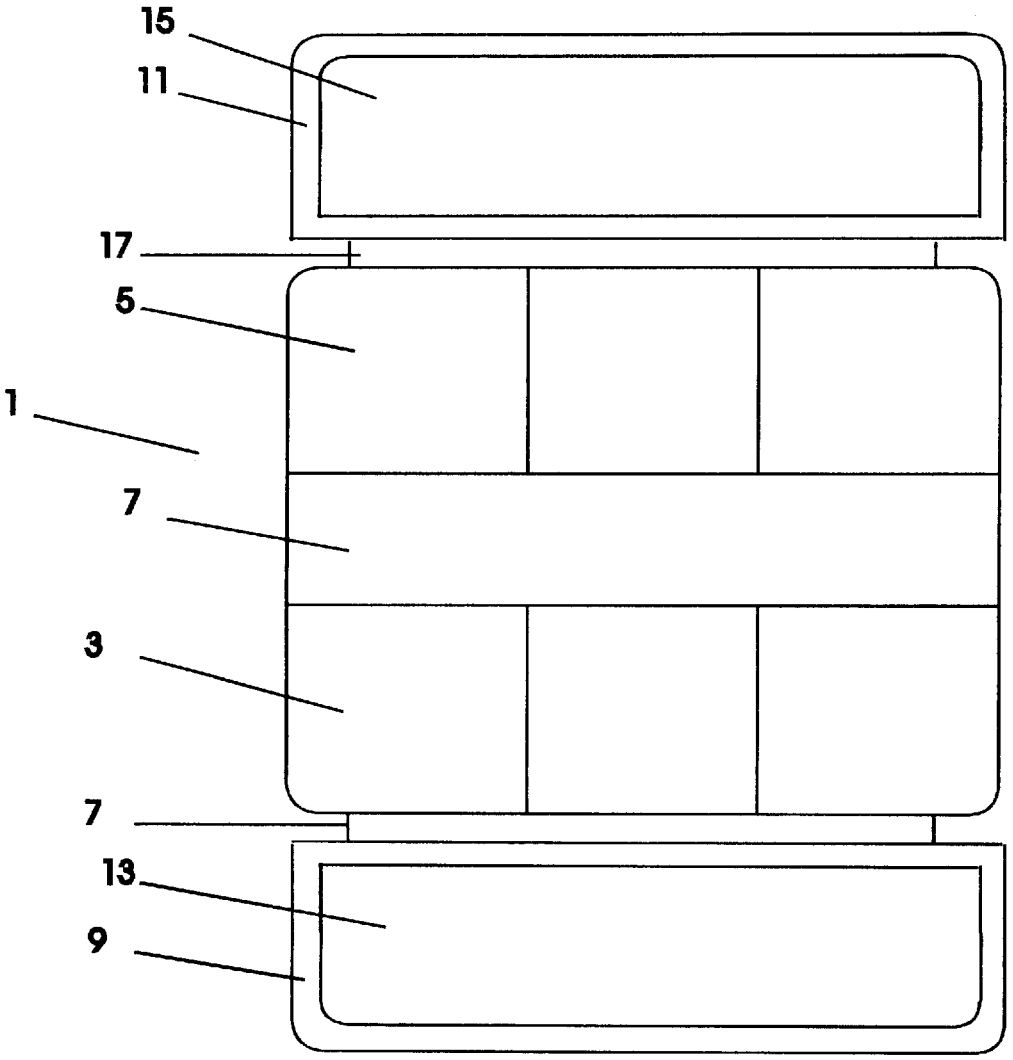
FIG. 3 shows a top view of the unit with both lids open.

FIG. 3 shows a top view to further visually elucidate the structure of the basic unit. All numbers indicate segments as previously described.

Figure 4:
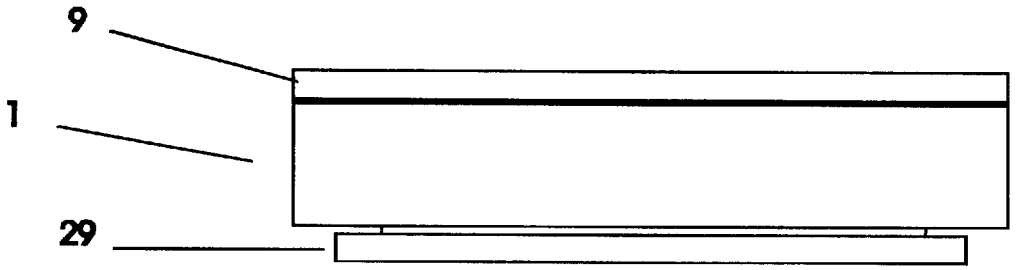
FIG. 4 shows a side view of the unit with a make-up kit attached to the bottom.

FIG. 4 shows a side view of the unit 1 with lid 9 in a closed position. In this embodiment a make-up kit 29 is attached to the bottom of the unit and a slide in instruction card 6 is shown on the top of lid 9. FIG. 4 also is a side view of FIG. 8 and FIG. 8 may be similarly equipped for multi-use.

Figure 5:
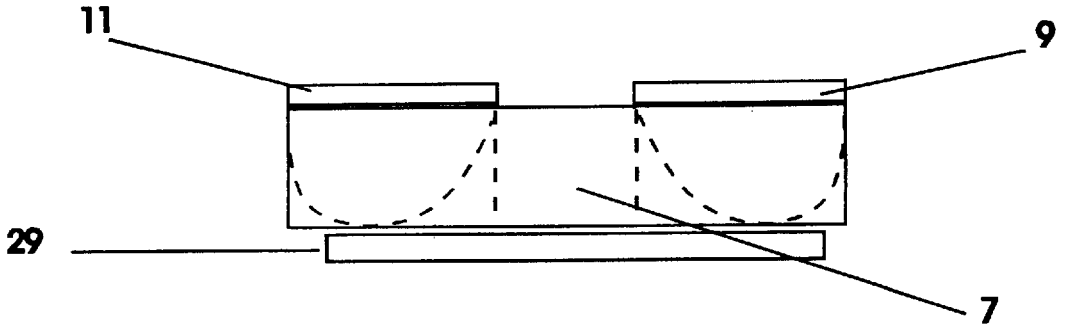
FIG. 5 shows an end view of the unit.

FIG. 5 shows an end view of the unit with lids 11 and 9 closed to form individual closed compartments and indicating the open end of channel 7 with a side view of make-up kit attached on the bottom of the unit. An end view of instruction card 6 partially in place is shown.

Figure 6:
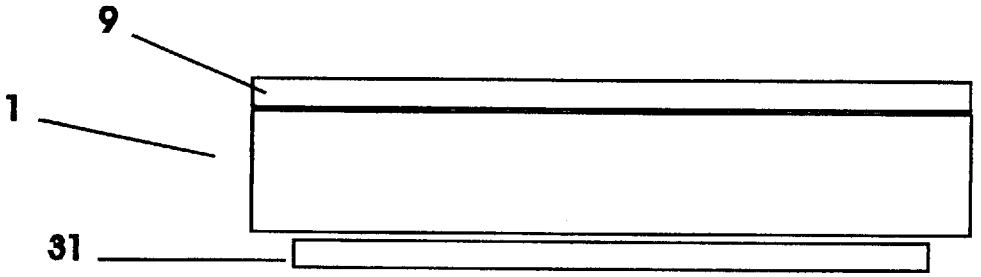
FIG. 6 shows an embodiment of the unit wherein a computer is attached to the bottom.

FIG. 6 shows the unit as previously described but with a very small computer 31 replacing the make-up kit.

Figure 7:
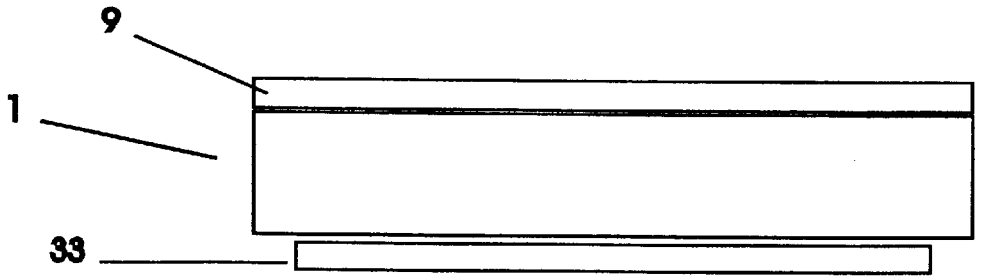
FIG. 7 shows an embodiment wherein an alarm is attached to the bottom of the unit.

FIG. 7 shows the unit as previously described but with a settable alarm 33 that rings a bell at four, six, eight, or twelve hour intervals as chosen by the user.

Figure 8:
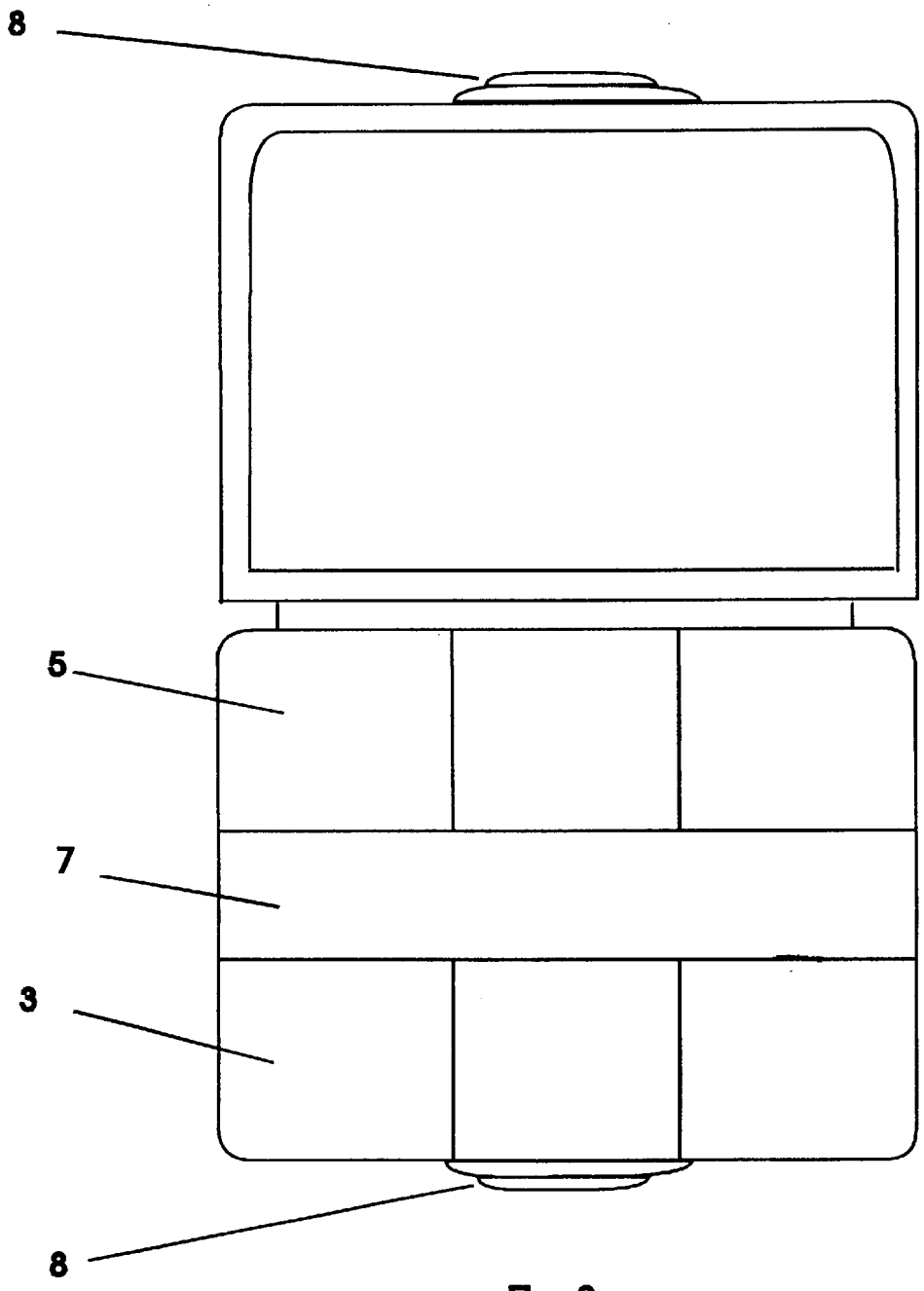
FIG. 8 shows an embodiment of the unit wherein the unit has a single lid.

FIG. 8 is exactly similar to FIG. 1 with the exception that lids 9 and 11 are replaced with a single lid 10. With a single lid 10 accessories such as the timer 31, the makeup kit 29 or the computer 31 may then be placed either on the top or bottom of the unit.

What is claimed is:

1. A portable multipurpose pill box container comprising:

a) a plastic boxlike structure b) a first elongated rounded bottom compartment a center compartment with an open end and a second elongated rounded bottom compartment in said boxlike structure with both said first and said second elongated compartments having indentations to allow subdividing said compartments using flat plastic segments;

c) dual plastic lids with a formed in place plastic hinge with each of said plastic lids snapping in place to cover one of said elongated compartments in said boxlike structure.

2. A portable multipurpose pill box container as in claim 1 further comprising removable inserts in each of said plastic lids, said removable inserts each having a surface to allow writing and erasure.

3. A portable multipurpose pill box container as in claim 1 further comprising a make-up kit attached to a bottom of said boxlike structure.

4. A portable multipurpose pill box container as in claim 1 further comprising a computer attached to a bottom of said boxlike structure.

5. A portable multipurpose pill box container as in claim 1 further comprising an alarm attached to a bottom of said boxlike structure.

6. A portable multipurpose pill box container as in claim 1 further comprising a holder to allow inserting a card with a writeable surface to essentially cover both of said lids.

7. A portable multipurpose pill box container comprising:

a) a plastic boxlike structure, b) a first elongated rounded bottom compartment, a center compartment with an open end, and a second elongated rounded bottom compartment in said boxlike structure with both said first and said second elongated compartments having indentations to allow subdividing said compartments using flat plastic segments;

c) a single plastic lid with a formed in place plastic hinge attached to one side of said boxlike structure and with said plastic lid covering both of said elongated compartments in said boxlike structure.

8. A portable multipurpose pill box container as in claim 7 further comprising removable inserts in said plastic lid, said removable inserts each having a surface to allow writing and erasure.

9. A portable multipurpose pill box container as in claim 7 further comprising a make-up kit attached to a bottom of said boxlike structure.

10. A portable multipurpose pill box container as in claim 7 further comprising a computer attached to a bottom of said boxlike structure.

11. A portable multipurpose pill box container as in claim 7 further comprising an alarm attached to a bottom of said boxlike structure.

12. A portable multipurpose pill box container as in claim 7 further comprising a holder to allow inserting a card with a writeable surface to essentially cover said lid.

* * * * *